US006786576B2

(12) United States Patent
Mitani

(10) Patent No.: US 6,786,576 B2
(45) Date of Patent: Sep. 7, 2004

(54) INKJET RECORDING HEAD WITH MINIMAL INK DROP EJECTING CAPABILITY

(76) Inventor: Masao Mitani, 54-1, Sawatan, Kanagawa-ku, Yokohama-shi, Kanagawa-ken (JP)

( * ) Notice: Subject to any disclaimer, the term of this patent is extended or adjusted under 35 U.S.C. 154(b) by 0 days.

(21) Appl. No.: 10/345,382

(22) Filed: Jan. 16, 2003

(65) Prior Publication Data

US 2003/0132990 A1 Jul. 17, 2003

(30) Foreign Application Priority Data

Jan. 17, 2002 (JP) ..... 2002-044008

(51) Int. Cl.[7] ..... B41J 2/05
(52) U.S. Cl. ..... 347/63
(58) Field of Search ..... 347/56, 63, 61, 347/65, 67, 45, 47, 85–87; 29/611; 216/27

(56) References Cited

U.S. PATENT DOCUMENTS 5,697,144 A * 12/1997 Mitani et al. ..... 347/65

FOREIGN PATENT DOCUMENTS

| | | | |
|---|---|---|---|
| JP | 61-154947 | 7/1986 | ..... B41J/3/04 |
| JP | 6-71888 | 3/1994 | ..... B41J/2/05 |
| JP | 7-227967 | 8/1995 | ..... B41J/2/05 |
| JP | 8-20110 | 1/1996 | ..... B41J/2/05 |
| JP | 8-207291 | 8/1996 | ..... B41J/2/16 |
| JP | 10-151744 | 6/1998 | ..... B41J/2/05 |

* cited by examiner

*Primary Examiner*—Raqual Yvette Gordon
(74) *Attorney, Agent, or Firm*—McGuireWoods LLP

(57) ABSTRACT

An inkjet recording head and an apparatus including the inkjet recording head are provided for expelling a fine ink drop which is less than or equal to 1 pico-liter (pl). The inkjet recording head has a substrate having a heater for ejecting an ink drop, and an ink feed inlet formed thereon; a barrier layer having an ink passage which communicates the ink feed inlet with the heater; and an orifice plate having an ink nozzle formed facing the heater, the ink nozzle communicating with the ink passage. The barrier layer is made from a negative photosensitive resin. The orifice plate includes a metallic thin film having a thickness in a range of about 0.1 to 2.0 $\mu$m.

11 Claims, 6 Drawing Sheets

INKJET RECORDING HEAD WITH MINIMAL INK DROP EJECTING CAPABILITY

BACKGROUND OF THE INVENTION

1. Field of the Invention

This invention relates to a top-shooter thermal inkjet recording head from which an ink drop is expelled toward a recording medium by means of thermal energy, and a recording apparatus using the inkjet recording head.

2. Description of the Prior Art

Some known method for manufacturing a top-shooter thermal inkjet recording head are described as follows:

Hewllett Packard Journal 36, 5 (1985) discloses using a photoresist to form an ink passage on a substrate having a heater for expelling an ink drop, and aligning and attaching an orifice plate having an ink nozzle to the substrate.

Japanese patent application publication 61-154947 discloses a dissolvable Ni or resin film to pattern an ink passage in a substrate having a heater for expelling an ink drop, cover and cure the patterned resin with an epoxide resin film. Then, the patterned resin is dry-etched to form an ink nozzle. The dissolvable Ni or resin film id dissolved to form the ink passage.

Japanese patent application publication 8-207291 discloses using a resin to form an ink passage on a substrate having a heater for expelling an ink drop. A resin film is attached on the substrate, and photo-etched to form an ink nozzle.

Especially, the method that uses only photo-etching processes enables forming ink nozzles at a high density and on a large scale.

In a conventional inkjet recording head, a resin thin film is used as the orifice plate. However, it is difficult to form the orifice plate having a thickness less than 10 $\mu$m from a manufacturing point of view. For example, the method disclosed in Japanese patent application publication 61-154947 forms the orifice plate by spin-coating a liquid resin on the ink passage pattern, because the passage pattern has many pits and projections. Thus, it is difficult to make the resin film around the ink nozzle thin and uniform over the substrate. The method disclosed in Japanese patent application publication 8-207291 attaches a resin film over ink passage on the substrate. However, it is difficult to attach a thin film having a thickness less than 10 $\mu$m from a manufacturing point of view.

Here, the relationship between the size of ejected ink drops and the thickness of the orifice plate will be explained. FIG. 1 is a vertical cross section of a conventional top-shooter inkjet recording head having an ink feed channel. FIG. 2 is a cross section taken along line II—II of FIG. 1. Ink is fed from a back surface of the substrate 1 to an ink nozzle 10 through an ink feed inlet 6, an ink feed channel 7, a common ink passage 8, and an separate ink passage 9. Electric power is fed to a heater 2 to generate nucleate boiling in the ink for expelling an ink drop. The expanding force of the resultant bubble ejects the ink drop from the ink nozzle 10.

This type of inkjet head has the ink nozzle 10 extending vertically through the orifice plate. If the sum of the thickness of a barrier layer 3 and the orifice plate 16 is smaller than about 30 $\mu$m, the amount of expelled ink is constant, and no cavitation occurs to the heater. Japanese patent application publications 7-227967 and 8-20110 describe that the amount of expelled ink is proportional to the ink volume located over the heater 2. According to these patent publications, a proportional constant is about 0.5 to 0.7, depending on the head structure. Therefore, in order to form an ink drop having a volume of about 1 pico-liter (pl) ($15\times15\times5$ $\mu m^3$), the sum of the thickness of the barrier layer 3 and the orifice plate 16 must be less than at least 10 $\mu$m. However, it is difficult to form an orifice plate having a thickness of less than 10 $\mu$m using conventional methods. As a result, it is difficult to make an ink drop having a volume less than or equal to 3 pl.

An object of the present invention is to provide an inkjet recording head which can expel an ink drop having a volume less than or equal to 3 pl.

Another object of the present invention is to provide a method for manufacturing an inkjet recording head which can expel an ink drop having a volume less than or equal to 3 pl.

SUMMARY OF THE INVENTION

The above disadvantages associated with the prior art are overcome by the present invention of an inkjet recording head, having: a substrate having a heater for ejecting an ink drop, and being formed with an ink feed inlet; an orifice plate having an ink nozzle formed facing the heater, and a barrier layer provided between the substrate and the orifice plate, the barrier layer having an ink passage that brings the ink feed inlet and the ink nozzle into fluid communication with each other; the barrier layer being formed from a negative photosensitive resin, and the orifice plate including a metallic thin film having a thickness in a range of about 0.1 to 2.0 $\mu$m.

According to the present invention, the inkjet recording head can expel an ink drop having a volume less than or equal to 1 pl. Additionally, it is easy to manufacture the inkjet recording head having a water-repellent film on a surface of the head by simple processes. Throughput of manufacturing can be improved. A fine color image can be printed at a high speed and at a lower cost.

The present invention further features an ink cassette, having an inkjet recording head including: a substrate having a heater for ejecting an ink drop, and being formed with an ink feed inlet; an orifice plate having an ink nozzle formed facing the heater; and a barrier layer provided between the substrate and the orifice plate, the barrier layer having an ink passage that brings the ink feed inlet and the ink nozzle into fluid communication with each other; the barrier layer being formed from a negative photosensitive resin, and the orifice plate including a metallic thin film having a thickness in a range of about 0.1 to 2.0 $\mu$m.

According to the present invention, an ink tank of the ink cartridge can be maintained at a normal pressure. And, a volume of the ink tank can be increased.

The present invention features a recording apparatus, having an inkjet recording head including: a substrate having a heater for ejecting an ink drop, and being formed with an ink feed inlet; an orifice plate having an ink nozzle formed facing the heater; and a barrier layer provided between the substrate and the orifice plate, the barrier layer having an ink passage that brings the ink feed inlet and the ink nozzle into fluid communication with each other; the barrier layer being formed from a negative photosensitive resin, and the orifice plate including a metallic thin film having a thickness in a range of about 0.1 to 2.0 $\mu$m.

According to the present invention, the number of times the inkjet recording needs to be cleaned can be reduced.

The present invention features a method for manufacturing an inkjet recording head, having the steps of: providing a substrate having a heater for ejecting an ink drop, and being formed with an ink feed inlet; providing an orifice plate having an ink nozzle formed facing the heater; and providing a barrier layer provided between the substrate and the orifice plate. The barrier, layer has an ink passage that brings the ink feed inlet and the ink nozzle into fluid communication with each other. The barrier layer is formed from a negative photosensitive resin. And the orifice plate includes a metallic thin film having a thickness in a range of about 0.1 to 2.0 $\mu$m.

According to the present invention, a high level of throughput of manufacturing an inkjet recording head is obtained.

BRIEF DESCRIPTION OF THE DRAWINGS

The aforementioned aspects and other features of the invention are explained in the following description, taken in connection with the accompanying drawing figures wherein.

DETAILED DESCRIPTION OF THE EMBODIMENTS

Inkjet recording heads according to the embodiments of the present invention will be described while referring to the attached drawings.

Figure 1:
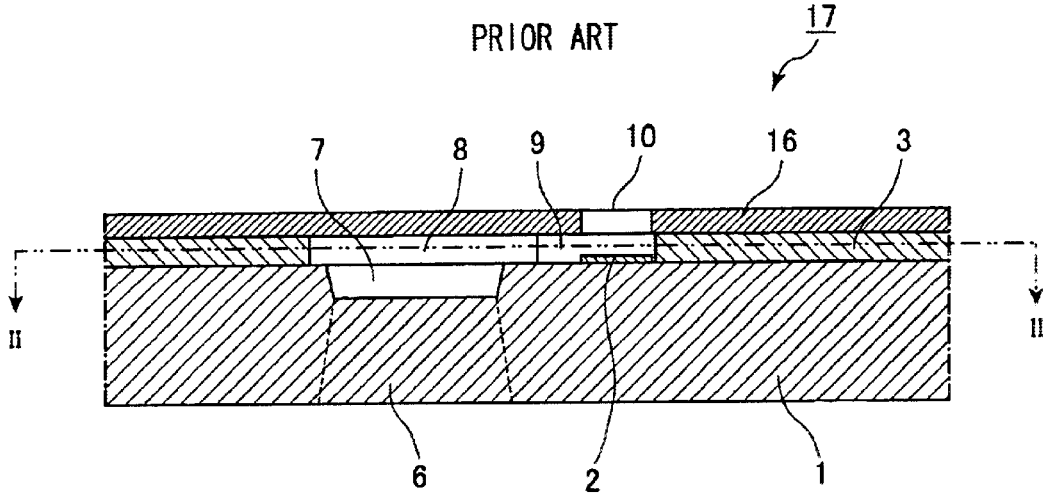
FIG.1 PRIOR ART
FIG. 1 is a cross sectional view showing a conventional top-shooter inkjet recording head.
Figure 2:
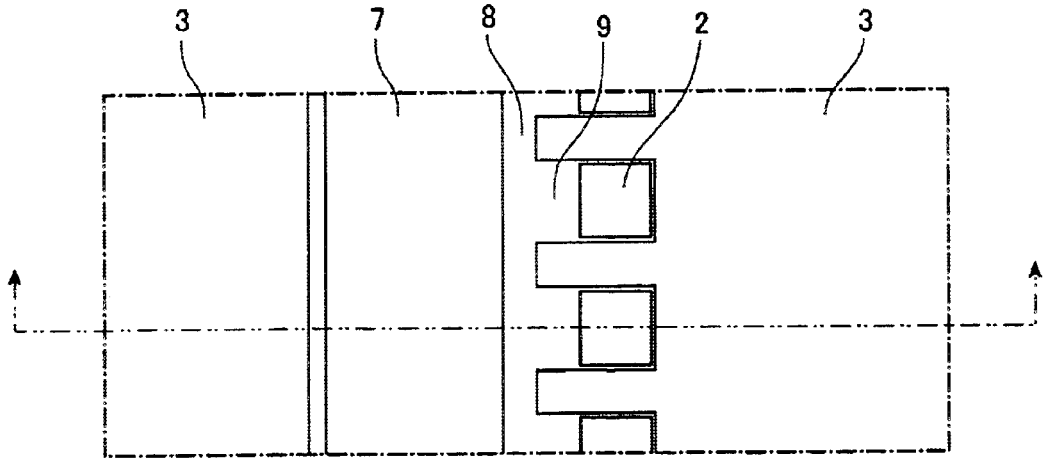
FIG.2 PRIOR ART
FIG. 2 is a cross sectional view taken along line II—II of FIG. 1.
Figure 3:
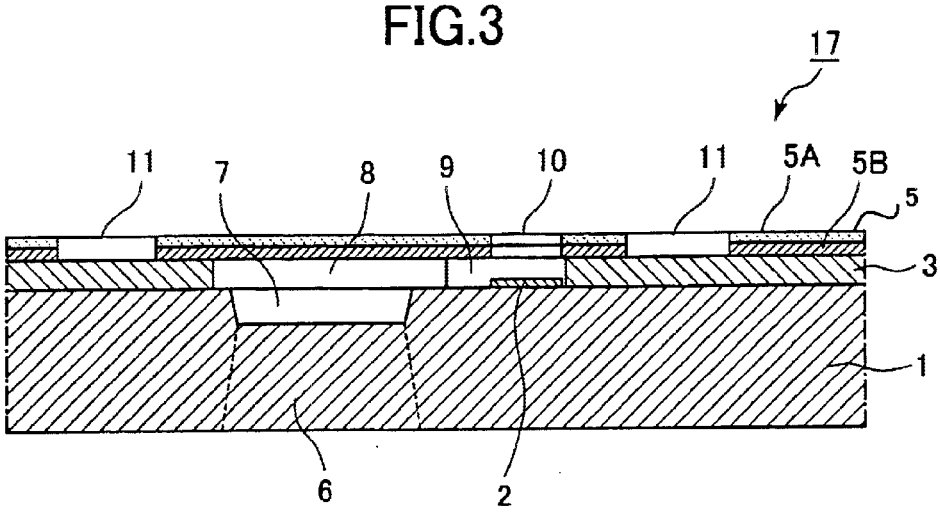
FIG. 3 is a vertical cross section showing an inkjet recording head of an embodiment according to the present invention.

FIG. 3 shows a head chip 17 of a first embodiment according to the present invention. Referring to FIG. 3, the head chip 17 is formed from a silicon (Si) substrate 1, a barrier layer 3 on the surface of the substrate, and an orifice plate 5 on the barrier layer 3. The head chip 17 has an ink feed inlet 6, an ink feed channel 7, ink passages 8 and 9, a heater 2 for ejecting ink drops, and an ink nozzle 10.

The ink feed inlet 6 is formed in the substrate 1 in fluid communication with an ink reservoir (not shown). The ink feed channel 7 is formed in a surface of the substrate 1 and the ink passage 9 is formed in the barrier layer 3. The ink feed channel 7 and the ink passage 9 bring the ink feed inlet 6 into fluid communication with the ink nozzle 10. The ink nozzle 10 is formed through the orifice plate 5. The heater 2 is positioned on the surface of the substrate 1 in alignment with the ink nozzle 10.

The orifice plate 5 includes a metallic thin film 5B formed on the barrier layer 3. The metallic thin film SB is covered with a water-repellent film 5A.

Figure 4:
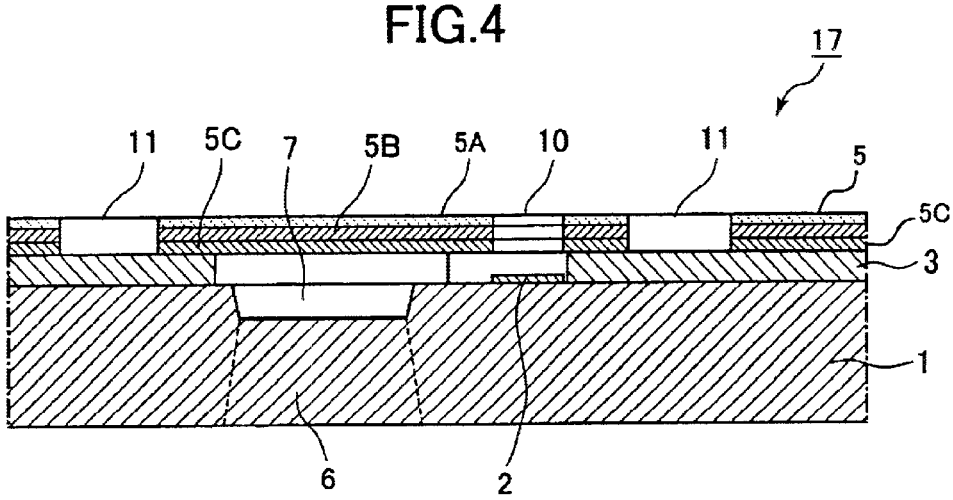
FIG. 4 is a vertical cross section showing an inkjet recording head of another embodiment according to the present invention.

FIG. 4 shows a head chip 17 of another embodiment according to the present invention. The head chip 17 of FIG. 4 has an orifice plate 5 including a light shield resin thin film 5C and the metallic thin film 5B. The light shield resin thin film 5C is formed on the barrier layer 3. The metallic thin film 5B is then formed on the light shield resin thin film 5C. The metallic thin film 5B is covered with the water-repellent film 5A. The head chip 17 of FIG. 4 has the same elements as those of the head chip 17 of FIG. 3 except for the structure of the orifice plate 5. It should be noted that the same numerals designate the same or corresponding parts in FIGS. 3 and 4.

Figure 5:
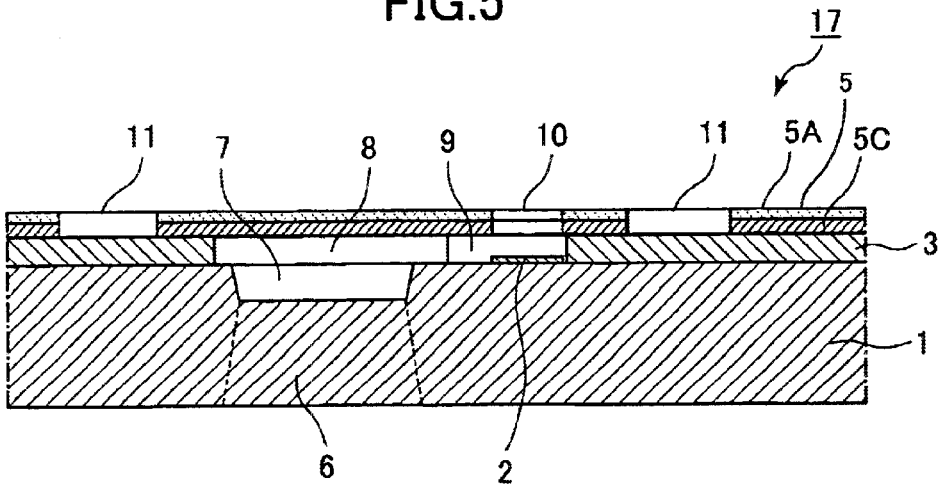
FIG. 5 is a vertical cross section showing an inkjet recording head of a further embodiment according to the present invention.

FIG. 5 shows a head chip 17 of a further embodiment according to the present invention. The head chip 17 of FIG. 5 has an orifice plate 5 including a light shield resin thin film 5C formed on the barrier layer 3. The light shield resin thin film 5C is covered with a water-repellent film 5A. The orifice plate 5 does not have a metallic thin film between the light shield resin thin film 5C and the water-repellent film 5A. The head chip 17 of FIG. 5 has the same elements as those of the head chip 17 of FIG. 3 except for the structure of the orifice plate 5. It should be noted that the same numerals designate the same or corresponding parts in FIGS. 3 and 5.

The ink feed channel 7 or the water-repellent film 5A may be omitted from any of the above embodiments. In this case, one of the steps for manufacturing the head chip 17 is also omitted so that the cost required to manufacture the head chip 17 can be decreased.

Referring to FIGS. 6A–6I, steps for manufacturing the head chip 17 of FIG. 4 will be explained. In this embodiment, the head chip 17 is considered to have a plurality of aligned nozzles. Actually, during manufacture, nozzle lines are formed in the orifice plate on both sides of the ink feed channel 7. Each head chip includes a plurality of ink feed channels 7 with its own nozzles. A group of head chips are formed on one Si substrate 1 having driver circuits thereon.

Figure 6A:
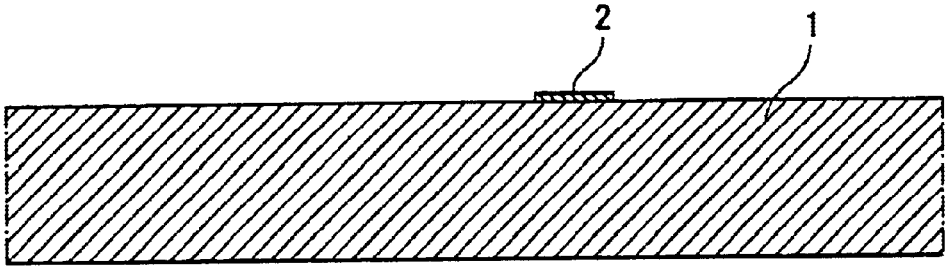
FIGS. 6A–6I are views showing processes for manufacturing an inkjet recording head according to the present invention.

FIGS. 6A–6I show steps for manufacturing a head chip 17 for an inkjet recording head. Referring to FIG. 6A, a heater 2 for ejecting an ink drop and a driver large-scale integration (LSI) circuit (not shown) are prepared on a Si substrate 1 in advance. A head chip 17 is formed on the substrate 1 by the following processes. It should be noted that a conventional type of heater having a surface covered with a protective layer may be used as the heater 2. The heater 2 may be a heating resistor consisting of only an insulating self-oxide film as disclosed by Japanese patent application publication 6-71888.

Figure 6B:
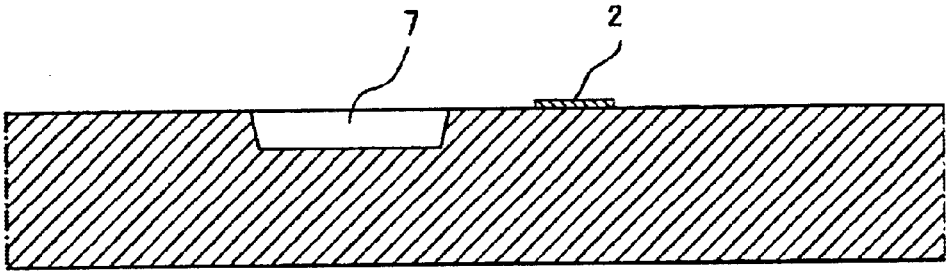

Referring to FIG. 6B, the substrate 1 is coated with a rubber-based photoresist (not shown), which is then exposed and developed. The substrate 1 is sandblasted to form an ink feed channel 7. It should be noted that anisotropic etching for Si may be used instead of sandblast.

It is preferable that the ink feed channel 7 has a depth that is one to five times the thickness of a barrier layer 3 described hereinafter. This is because the ink feed channel 7 is required to be filled with a positive photoresist 13 in the next step. Additionally, the depth of the ink feed channel 7 is required to be sufficiently deep to feed ink from the ink feed inlet 6 to the ink passages 8 smoothly.

Figure 6C:
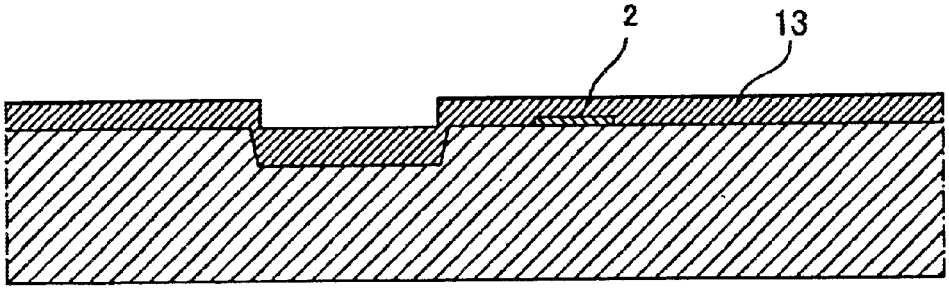
Figure 6D:
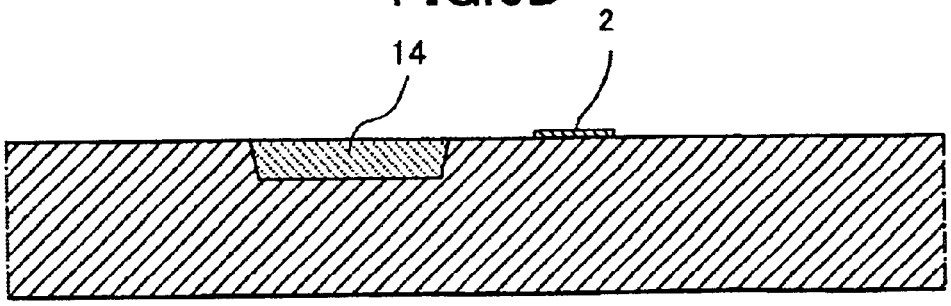

Referring to FIG. 6C, a positive photoresist 13 is coated over the substrate 1, and exposed through an ink feed channel pattern mask (not shown). After the photoresist 13 is developed, only the photoresist 14 that remains in the ink feed channel 7 is exposed as shown in FIG. 6D. It is preferable that the ink feed channel 7 is smoothly and uniformly filled with the exposed positive photoresist 14. The positive photoresist is used because the exposed photoresist in the ink feed channel 7 is easy to be dissolved in a later step.

Figure 6E:
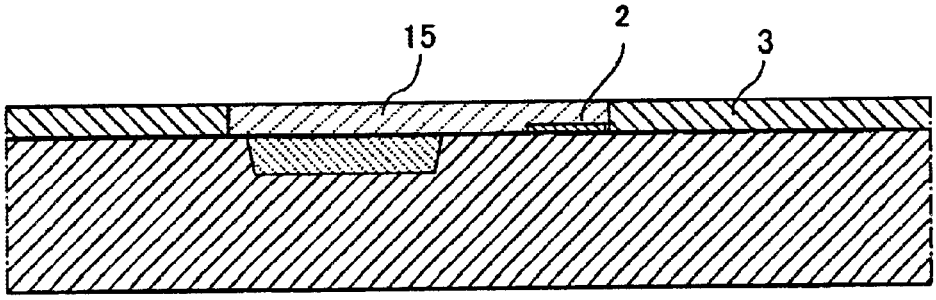

Referring to FIG. 6E, a negative photoresist is then coated and exposed through a barrier layer pattern mask (not shown). A negative photoresist is used because the resultant barrier layer 3 will not expand by ink.

Figure 6F:
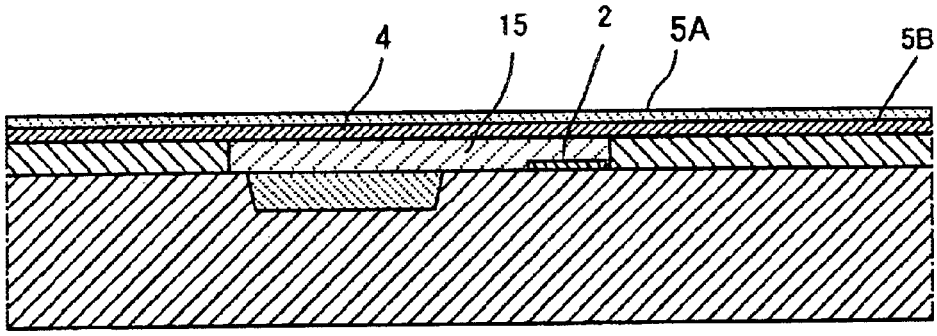
Figure 6G:
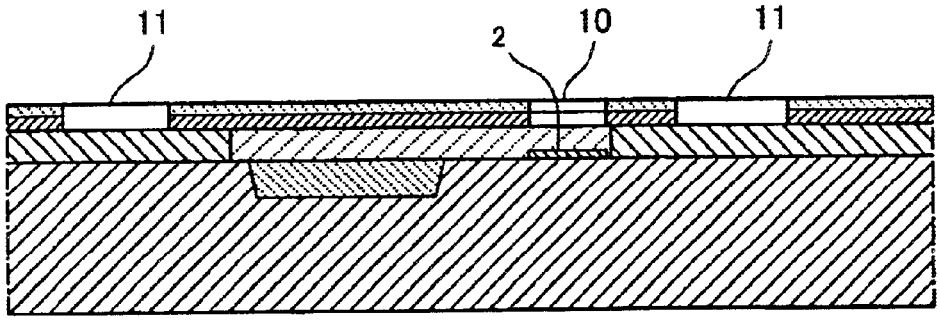

Referring to FIG. 6F, a metallic thin film 5B is then formed on the negative photoresist layer as the barrier layer 3. The metallic thin film 5B is then covered with a water-repellent film 5A. After a photoresist (not shown) is further coated over the water-repellent film 5A, the photoresist is exposed and developed through an ink nozzle pattern mask (not shown). The water-repellent film 5A and the metallic thin film 4 are etched in turn to provide a nozzle 10 and an opening area 11 as shown in FIG. 6G. The metallic thin film 5B is adopted into an orifice plate 5, because the metallic thin film 5B must exhibit light-shielding properties to avoid light beams used in the photo-etching process from affecting the underlying unexposed photoresist layer 15. Additionally, the metallic thin film 5B is required to be made from a material having sufficient mechanical strength, even if the film 5B is made thin. The metallic thin film SB may be made from a metal such as Au, Pt, Ni, or Ta. Alternatively, the metallic thin film SB may be made from an alloy thin film or a mutilayered film. The thickness of the metallic thin film 5B should be equal to or greater than 0.05 $\mu$m to provide sufficient light shielding properties. However, it is preferable that the maximum thickness of the metallic thin film 5B is substantially 3 $\mu$m in order to avoid peeling and other problems due to an internal stress induced during the formation of the thin film. In practice, the metallic thin film 5B preferably has a thickness in a range of about 0.1 to 2.0 $\mu$m.

It should be noted that sputtering and metal deposition must not be used in forming the above metallic thin film, because sputtering and metal deposition produce visible or ultraviolet light that exposes the unexposed photoresist 15. In this embodiment, ion plating is used because it emits no light. However, even if ion plating is used, thermal energy may be generated when metallic vapor contacts the photoresist. Accordingly, it is preferable to use a photoresist that has sufficient heat-resistant properties. A cluster ion beam process may be adopted for forming a metallic thin film at a lower temperature than that of ion plating. If a cluster ion beam process is used, a photoresist need not have heat resistant properties. In any case, the metallic thin film 5B may provide sufficient light shielding properties, when the film 5B has a thickness equal to or greater than 0.05 $\mu$m. Accordingly, the ion plating or the cluster ion beam process may be first used to form the metallic thin film 5B, until the thickness of the film 5B reaches 0.05 $\mu$m. The sputtering process is then used to maintain the formation of the metallic thin film 5B, until the thickness of the film 5B reaches a desired value. For example, the ion plating process is first used to form an Au thin film until the thickness of the film reaches 0.1 $\mu$m. Then, the sputtering process is used to maintain the formation of the film. In this case, the amount of Au consumed can be substantially reduced.

When the negative photoresist layer for forming the barrier layer 3 is heated to dry, generally, the solvent in the photoresist is evaporated to shrink the photoresist. It is necessary to consider vaporization and shrinkage properties of the negative photoresist for the barrier layer 3. Therefore, it is important to select a photoresist that has a low content of solvent and so low shrinkage. It is also necessary to minimize the area of metallic thin film to be formed on the photoresist layer. Accordingly, it is preferable to use a photoresist such as CYCLOTENE (Trademark of The Dow Chemical Company) 4000 series resin. The orifice plate is formed only on an area over the ink passage and the surrounding area of the ink passage, as shown in FIGS. 3, 4, 5, and 6A–6I. Generally, the water-repellent film 5A may be a fluoride resin film formed by a conventional film forming process such as sputtering. The photoresist layer may not adhere sufficiently to the water-repellent film 5A, when the photoresist is coated over the water-repellent film 5A to form the ink nozzle 10. In this case, sufficient adhesion between the photoresist and the water-repellent film 5A can be induced by processing the water-repellent film 5A by means of oxygen plasma ashing to make water-repellent film 5A hydrophilic.

Figure 6H:
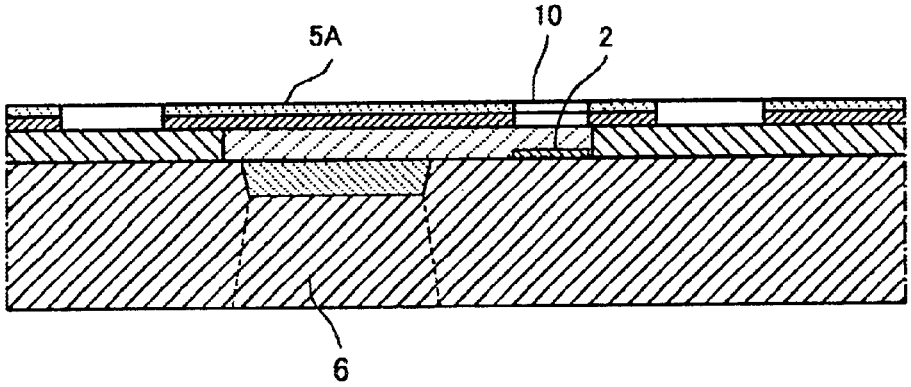

Referring to FIG. 6H, an ink feed inlet 6 is formed from the back side of the substrate 1 by means of sandblasting or anisotropic etching. To make the ink feed inlet 6, a patterning process that uses a photoresist can be used.

Figure 6I:
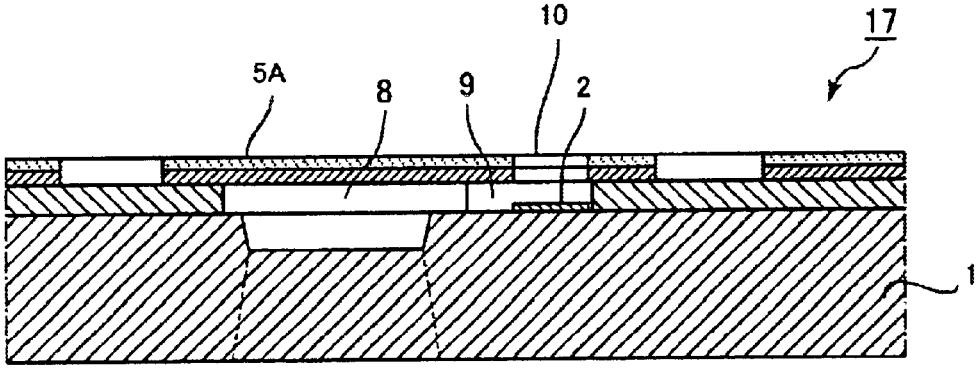

Referring to FIG. 6I, the exposed positive photoresist layer 14 and the unexposed negative photoresist layer 15 are dissolved during a developing process, so that the ink feed channel 7 and the ink passage 8 are completed. After that, a surface of the water-repellent film 5A is processed by Ar-ion implantation to obtain a water-repellent property. The substrate 1 is divided by a designed unit to provide one head chip 17. When the water-repellent film 5A is formed from a fluoride resin film such as polytetrafluoroethylene (PTFE) film. The fluoride resin film can achieve a contact angle of 170 degrees with respect to water with the above water-repellent process. The fluoride resin film may achieve a contact angle greater than 100 degrees with respect to ink which has less surface tension than that of water. The processing order of Ar-ion implantation and the formation of the ink passage may be reversed.

In this embodiment, a dry etching process is used to etch the fluoride resin film having a thickness of 1 $\mu$m, when the fluoride resin film consists of the water-repellent film. When a conventional inkjet recording head is manufactured, a water-repellent film having a thickness greater than 10 $\mu$m must be dry-etched. The present invention shortens the time required to dry-etch a water-repellent film, compared with the conventional process. Thus, the present invention is cost-effective.

When a recording head is manufactured without being covered with the water-repellent film 5A, all steps for forming the water-repellent film can be dispensed with. Accordingly, the process for manufacturing the recording head is simplified. When a small inkjet recording head having a short ink nozzle line with no ink feed channel 7 is manufactured, the ink feed inlet 6 need not be formed over the length of the nozzle line. Therefore, a high level throughput of manufacturing an inkjet recording head is maintained. Additionally, there is no need to form an ink feed channel, so that all steps of forming the ink feed channel can be omitted.

By using the steps described above, an orifice plate having a thickness in a range of 1.0 to 2.0 $\mu$m and including a water-repellent film can be formed. Accordingly, a series of ink nozzles, each of which has a 10 $\mu$m diameter nozzle facing a 11 $\mu$m×11 $\mu$m heater, are provided in the inkjet head at an arranged density of 1440 npi (nozzle/inch). This inkjet head is able to expel a fine ink drop having a volume of about 0.8 pl. This volume exceeds a visible limit of 1 pl. High speed ultra-fine full color printing and lower cost printing are achieved simultaneously. The only surface of the orifice plate in the inkjet head repels liquid such as water and ink. Accordingly, ink cannot leak out onto the surface of the inkjet head. Additionally, the ink tank can be maintained at a normal pressure, without using a pseudo-high resolution technique using a lower concentration ink such as disclosed in Japanese patent application publication 10-151744. The no leak feature for the ink and the ink tank being maintained at a normal pressure enable a substantial decrease in the number of cleanings of the inkjet head. As a result, the printing speed of a printer provided with the above described inkjet head can be improved.

The following description will be made for explaining another factor to expel a ultra-fine ink drop. A conventional head chip structure has a nozzle having a smaller diameter to reduce the amount of ink on the heater, when an orifice plate cannot made any thinner. However, the nozzle diameter is about the order of one-tenth of the thickness of the orifice plate. A large fluid resistance of the nozzle reduces an ink expelling speed considerably. Additionally, it is very difficult to dissolve a material filling in the ink passage such as Ni or resin through a narrow and long nozzle hole. Therefore, it is impractical to reduce the nozzle diameter.

On the other hand, the present invention provides an inkjet recording head having a nozzle diameter which is several times the thickness of an orifice plate. The inkjet recording head of the present invention solves the problems in the prior art.

The following description will be made for explaining a method for manufacturing the head chip shown in FIG. 4. The head chip is featured by a metallic thin film which can be formed by using sputtering. The head chip 17 of FIG. 4 can be provided without using ion plating and/or a cluster ion beam process.

The processes up to the formation of the barrier layer 3 are the same as those of the head chip 17 of FIG. 3. The barrier layer 3 is covered with a light shield resin layer SC having a thickness of 1.0 to 3.0 μm by a sputtering process. The light shield resin layer SC is made from a resin having a property that interrupts light. A metallic thin film 5B and a water-repellent film 5A are then formed on the light shield resin layer SC in turn by a sputtering process. The light shield resin layer SC can be relatively easily produced by mixing a black pigment and/or a dye into a resin material. The formation of the light shield resin layer SC enables the metallic thin film 5B to be formed by a sputtering process, thereby reducing manufacturing costs. The following processes are the same as those of the head chip of FIG. 3.

In this embodiment, the minimum amount of each ink drop expelled from the head chip 17 of FIG. 4 is larger than that of the head chip 17 of FIG. 3 by a small amount. However, the minimum amount of ink drops ejected by the head chip of FIG. 4 is about one-third of a conventional head chip.

The head chip 17 of FIG. 5 includes a light shield resin layer 5C which has greater mechanical strength that resists pressure of an ink drop being expelled. The head chip 17 of FIG. 5 does not feature a metallic thin film. In order to obtain the above features, the light shield resin layer 5C is required to have a thickness in a range of about 3.0 to 10 μm. The process for manufacturing the head chip 17 of FIG. 5 is the same as that of the head chip 17 of FIG. 3 except that no metallic thin film is formed. This is a simplified process compared with other processes for the head chip 17 of FIGS. 3 and 4. The minimum amount of ink to be expelled from the head chip 17 is larger than that of the head chip 17 of FIG. 4. However, the minimum amount of ink from the head chip 17 of FIG. 5 is still half of that from a conventional head chip.

Some examples will be explained hereinafter.

EXAMPLE 1

A driver circuit and a heater for expelling an ink drop were formed on a Si substrate using general semiconductor processes. The heater has a size of 11 μm×11 μm. Nozzles are arranged at a density of 1440 npi.

A dry film resist such as ORDYL series from TOKYO OHKA KOGYO Co., Ltd. was laminated on the substrate by a laminator. The dry film resist was exposed through a pattern of the ink feed channel, and then developed. The substrate was sandblasted to provide an ink feed channel having a depth of 15 μm. The ink feed channel has a width of 150 μm. After the ink feed channel 7 was formed, the remaining dry film resist was removed by a cleaning process.

A positive photoresist such as ODUR series from TOKYO OHKA KOGYO Co., Ltd. was then coated on the substrate to form a positive photoresist layer. The pattern of the ink feed channel was exposed on the positive photoresist layer, and developed. The remaining photoresist was exposed. This process was repeated twice, so that the ink feed channel was filled with exposed positive photoresist.

A negative photoresist such as CYCLOTENE (Trademark of The Dow Chemical Company) 4000 Series was coated over the substrate to have a thickness of 6 μm, and then exposed through a pattern of the ink passage.

A metallic thin film such as a Ni thin film was then formed on the substrate by an ion plating process. A water-repellent film having a thickness of 0.7 μm such as a fluoride film (PTFE) was formed on the metallic thin film by a sputtering process. The water-repellent film was then treated by using an oxygen plasma ashing process to obtain a hydrophilic property.

A negative photoresist such as CYCLOTENE 4000 Series from Dow Chemical Company was coated over the substrate, exposed and developed through a pattern of the ink nozzle. After the water-repellent film was dry-etched, the metallic thin film was wet-etched to provide ink nozzles. Simultaneously, an opening area at a distance of about 100 μm from the ink nozzle was formed. It is sufficient that the opening area is located at a distance of 50–200 μm from an area corresponding to the ink passage.

The orifice plate having the metallic thin film and the water-repellent film is covered with an adhesive protecting film. A rubber-based photoresist film such as ORDYL series was then attached to a back surface of the substrate. The rubber-based photoresist film is exposed and developed with a pattern of the ink feed inlet, and sandblasted to provide an ink feed inlet in the substrate. When the Si substrate is sandblasted, it is possible to control a depth of the ink feed inlet within 5% of intended depth. In addition, the Si substrate 1 can be selectively processed with high precision, because the photoresist filled in the ink feed channel is processed at the speed which is about one-tenth of the processed speed of the Si substrate. Alternatively, a Si anisotropic etching process may be used to form the ink feed inlet.

The exposed photoresist in the ink feed channel is then removed from the back surface of the substrate, after the adhesive protecting film was removed. The unexposed photoresist in the ink passage was removed from both sides of the substrate. The head chip 17 was then heated and dried to finish the formation of the ink passage.

The water-repellent film is processed by an Ar-ion implantation process to enhance the water repellent property of the water-repellent film. After that, the Si substrate was divided in chip units to complete the head chip.

Figure 7:
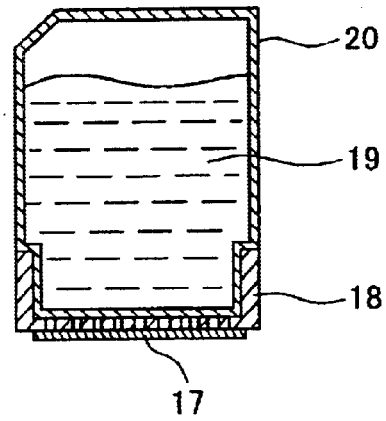
FIG. 7 is a view showing an ink cartridge and an ink tank according to the present invention.

As shown in FIG. 7, the head chip 17 is mounted in an ink cartridge 18. The ink cartridge 18 is then mounted into a carriage 21 of a printer shown in FIG. 8 with an ink tank 20. The ink tank 20 has the same internal pressure as atmospheric pressure. Accordingly, the ink tank 20 can contain substantially twice the ink volume 19 as that of a conventional ink tank, because the conventional ink tank is required to be maintained at a lower pressure. Additionally, a unit which is required to maintain the ink tank at the lower pressure can be dispensed with, so the cost of the printer carriage can be reduced.

Figure 8:
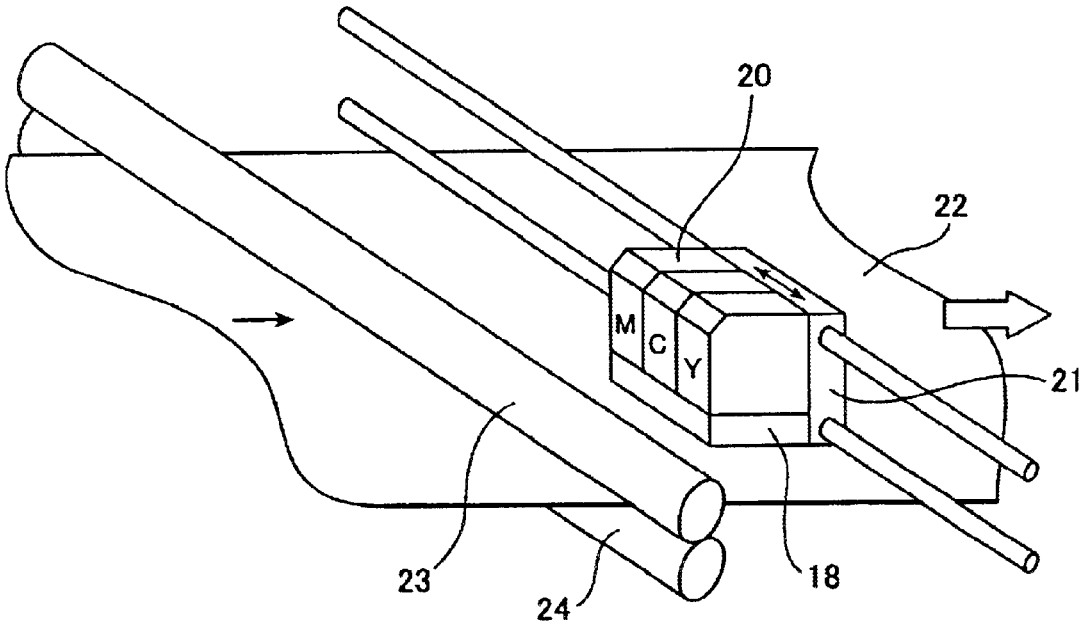
FIG. 8 is a view showing a printer including the inkjet recording head of the present invention.

The printer shown in FIG. 8 uses a heating roller 23 and a pressurizing roller 24 to pre-heat a recording sheet 22 at a temperature of 100° C. just prior to printing. As a result, printed ink dries on the sheet without spreading in the sheet, so printed images are maintained clear. Accordingly, an ink drop expelled from the inkjet head has a volume of 0.8 p1. And, a dot printed by the ink drop has a diameter of about 12 $\mu$m. This diameter of the dot is smaller than a 15 $\mu$m dot diameter that can be printed without pre-heating of the sheet. In this embodiment, the surface of the inkjet head is maintained clear. Accordingly, the printing speed can be increased, because interruption in the printing due to frequent cleaning of the inkjet head can be reduced. A long length inkjet head chip is manufactured, because damage to head chips caused by cutting the substrate 1 or mounting the head chip to the carriage can be substantially reduced.

As clearly described in the above example, the present invention enables forming the thinner orifice plate, so that ink drops that are smaller than the visible limit can be ejected. The thin orifice plate is enabled by adopting a metallic thin film as the orifice plate. Simultaneously, a negative photoresist can be adopted as a barrier layer due to the light shielding properties of the metallic thin film. In other words, if the metallic thin film lacks the light shielding properties, an unexposed photoresist filling inside the ink passage may be subject to exposure. Such an affect means a desired ink passage cannot be formed when the metallic thin film lacks the light shielding properties.

As is clear from the above description, the barrier layer is formed from a negative photoresist exhibiting a light bridging reacting. And, the barrier layer must have a permanent structural strength and resistance to ink. It is preferable that the negative photoresist exhibits heat resistance, which saves considerable power to manufacture an inkjet recording head using a heat resistor consisting of an insulating self-oxide thin film disclosed in Japanese patent application publication 6-71888. A CYCLOTENE 4000 series photoresist is an optimal material because of its heat resistance. Alternatively, any other suitable photoresist such as Poly Benz Oxazol from SUMITOMO BAKELITE Co., Ltd, and PL-H708 and HD-6000 series from Hitachi chemical and DupontElectronics MicroSystems can be used.

This first example explains an inkjet recording head for expelling a finer ink drop than conventional heads can eject. However, it inkjet recording heads can be modified to eject larger ink drops by enlarging the heater and/or increasing thickness of the barrier layer. Such a large-drop ejecting head can be manufactured according to the present invention more easily than using conventional methods.

It is also easy to impart water-repellent properties to only the surface of the orifice plate. Accordingly, the number of cleaning processes can be reduced.

Additionally, the ink tank can be maintained at a normal pressure, which is not possible with conventional technology. The above structure can decrease the cost of the ink cartridge.

EXAMPLE 2

The following description will be made for explaining a head chip having another structure shown in FIG. 4.

The processes up to providing a negative photoresist for a barrier layer 3 as shown in FIG. 6E are the same as for Example 1. Then, a light shield resin film is formed over the negative photoresist layer. A metallic thin film and a water-repellent film 5A are formed in turn on the light shield resin layer by a sputtering process. The formation of the light shield resin layer enables the metallic thin film to be formed by a normal sputtering process. After this process, the remaining processes after an ink nozzle and an opening area are photo-etched are the same as those for Example 1. Polyimide resin mixed with carbon fillers having a diameter of about 0.2 $\mu$m is used as the light shield resin. The light shield resin layer has a thickness of 2 $\mu$m. Preferably, the light shield resin layer has a thickness sufficient to avoid light of a glow discharge induced by a sputtering process from exposing an unexposed negative photoresist. Therefore, the light shield resin layer may have a thickness of 1.0 to 5.0 $\mu$m. In this example, the metallic thin film has a thickness of 0.5 $\mu$m. The metallic thin film is formed thicker for the orifice plate consisting of a three layer structure in order to achieve a mechanical strength to withstand an expelling pressure of an ink drop and a cleaning process. Preferably, the orifice plate has a thickness in a range of 1.0 to 5.0 $\mu$m.

The second example has an advantage of reducing the cost for manufacturing the inkjet recording head.

EXAMPLE 3

The processes for manufacturing a head chip shown in FIG. 5 do not include a process for forming a metallic thin film. Preferably, an orifice plate consisting of only a light shield resin layer and a water-repellent film has mechanical strength sufficient to withstand pressure for expelling the ink and cleaning processes. Preferably, the light shield resin layer has a thickness range of 3 to 10 $\mu$m. Accordingly, minimum amount of an expelled ink drop can be reduced to half that of the conventional amount of an expelled ink drop.

In this example, a polyimide resin can be used as a light shield resin material. Preferably, the light shield resin layer has a thickness of 3.0 to 4.0 $\mu$m to achieve a proper heat resistance and sufficient mechanical strength. In this embodiment, the process for forming an ink nozzle can be performed simultaneously with the process for treating a fluo-resin film. Accordingly, the cost for manufacturing an inkjet recording head can be reduced.

The above inkjet recording head of Examples 2 and 3 can expel ink drops with a minimum amount of 1.2 and 1.4 pl, respectively.

As described above, the orifice plate of the head chip of the present invention is covered with the water-repellent film. Accordingly, the head needs to be cleared less frequently. Additionally, the pressure of the cleaning wiper applied to the inkjet recording head can be reduced. Thus, the orifice plate does not need to have great mechanical strength.

It is understood that the foregoing description and accompanying drawings set forth the preferred embodiments of the invention at the present time. Various modifications, additions and alternative designs will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

What is claimed is:

1. An inkjet recording head, comprising:

a substrate having a heater for ejecting an ink drop, and being formed with an ink feed inlet;

an orifice plate having an ink nozzle formed facing the heater; and a barrier layer provided between the substrate and the orifice plate, the barrier layer having an ink passage that brings the ink feed inlet and the ink nozzle into fluid communication with each other, the barrier layer being formed from a negative photosensitive resin, and the orifice plate being made from a metallic thin film, the orifice plate having a thickness in a range of about 0.1 to 2.0 $\mu$m.

2. The inkjet recording head according to claim 1, wherein the orifice plate includes a multilayer film having the metallic thin film and a light shield resin thin film, the multilayer film having a thickness in a range of about 2 to 5 $\mu$m.

3. The inkjet recording head according to claim 1, wherein the orifice plate includes a light shield resin thin film having a thickness in a range of about 3 to 10 $\mu$m.

4. The inkjet recording head according to claim 1, wherein a surface of the orifice plate is covered with a water-repellent film.

5. The inkjet recording head according to claim 1, wherein the orifice plate is formed only over the ink passage and a surrounding area of the ink passage.

6. The inkjet recording head according to claim 1, wherein the substrate includes the heater, the ink feed inlet, an ink feed channel.

7. An ink cassette, comprising an inkjet recording head including:

a substrate having a heater for ejecting an ink drop, and being formed with an ink feed inlet;

an orifice plate having an ink nozzle formed facing the heater; and a barrier layer provided between the substrate and the orifice plate, the barrier layer having an ink passage that brings the ink feed inlet and the ink nozzle into fluid communication with each other, the barrier layer being formed from a negative photosensitive resin, and the orifice plate including a metallic thin film having a thickness in a range of about 0.1 to 2.0 $\mu$m.

8. A recording apparatus, comprising an inkjet recording head including:

a substrate having a heater for ejecting an ink drop, and being formed with an ink feed inlet;

an orifice plate having an ink nozzle formed facing the heater; and a barrier layer provided between the substrate and the orifice plate, the barrier layer having an ink passage that brings the ink feed inlet and the ink nozzle into fluid communication with each other, the barrier layer being formed from a negative photosensitive resin, and the orifice plate including a metallic thin film having a thickness in a range of about 0.1 to 2.0 $\mu$m.

9. A method for manufacturing an inkjet recording head, comprising the steps of:

forming a substrate having a heater for ejecting an ink drop, and being formed with an ink feed inlet;

forming an orifice plate having an ink nozzle formed facing the heater; and forming a barrier layer provided between the substrate and the orifice plate, the barrier layer having an ink passage that brings the ink feed inlet and the ink nozzle into fluid communication with each other, the barrier layer being formed from a negative photosensitive resin, and the orifice plate including a metallic thin film having a thickness in a range of about 0.1 to 2.0 $\mu$m.

10. The method according to claim 9, wherein the step of forming the orifice plate includes the step of forming a light shield resin thin film having a thickness in a range of about 3 to 10 $\mu$m.

11. The method according to claim 10, further comprising the step of covering a surface of the orifice plate with a water-repellent film.

* * * * *